US007113108B1

(12) United States Patent
Bachelder et al.

(10) Patent No.: US 7,113,108 B1
(45) Date of Patent: Sep. 26, 2006

(54) EMERGENCY VEHICLE CONTROL SYSTEM TRAFFIC LOOP PREEMPTION

(75) Inventors: Aaron D. Bachelder, Irvine, CA (US); Conrad F. Foster, Los Angeles, CA (US)

(73) Assignee: California Institute of Technology, Pasadena, CA (US)

( * ) Notice: Subject to any disclaimer, the term of this patent is extended or adjusted under 35 U.S.C. 154(b) by 287 days.

(21) Appl. No.: 10/410,582

(22) Filed: Apr. 8, 2003

Related U.S. Application Data

(60) Provisional application No. 60/371,037, filed on Apr. 9, 2002.

(51) Int. Cl.
*G08G 1/07* (2006.01)

(52) U.S. Cl. ..... 340/906; 340/907; 340/931; 340/941

(58) Field of Classification Search ..... 340/933, 340/941, 995.13, 995.2, 995.25
See application file for complete search history.

(56) References Cited

U.S. PATENT DOCUMENTS

| | | | | |
|---|---|---|---|---|
| 3,550,078 | A | 12/1970 | Long | |
| 3,831,039 | A | 8/1974 | Henschel | |
| 3,859,624 | A * | 1/1975 | Kriofsky et al. | 340/941 |
| 3,881,169 | A | 4/1975 | Malach | |
| 3,886,515 | A | 5/1975 | Cottin et al. | |
| 4,017,825 | A | 4/1977 | Pichey | |
| 4,162,477 | A | 7/1979 | Munkberg | |
| 4,223,295 | A | 9/1980 | Bonner et al. | |
| 4,230,992 | A | 10/1980 | Munkberg | |
| 4,234,967 | A | 11/1980 | Henschel | |
| 4,296,400 | A | 10/1981 | Friedbert et al. | |
| 4,433,324 | A | 2/1984 | Guillot | |
| 4,443,783 | A | 4/1984 | Mitchell | |
| 4,573,049 | A | 2/1986 | Obeck | |
| 4,661,799 | A * | 4/1987 | Buttemer | 340/941 |
| 4,701,760 | A | 10/1987 | Raoux | |
| 4,704,610 | A | 11/1987 | Smith et al. | |
| 4,713,661 | A | 12/1987 | Boone et al. | |
| 4,734,863 | A | 3/1988 | Honey et al. | |
| 4,734,881 | A | 3/1988 | Klein et al. | |

(Continued)

FOREIGN PATENT DOCUMENTS

EP 0 574 009 A2 12/1993

(Continued)

OTHER PUBLICATIONS

Co-pending U.S. Appl. No. 10/642,435; filed Aug. 15, 2003, entitled Emergency Vehicle Traffic Signal Preemption System.

(Continued)

*Primary Examiner*—Benjamin C. Lee
*Assistant Examiner*—Son Tang
(74) *Attorney, Agent, or Firm*—Christie, Parker & Hale, LLP

(57) ABSTRACT

An emergency vehicle traffic signal preemption system using existing inductive traffic loops that is either "car-active" or "car-passive". In the "car-active" system, a passive element having position information transmits an ID tag and the position information to a transceiver in the vehicle when an emergency vehicle is detected by the existing inductive traffic loop. In the "car-passive" system, a transceiver at the intersection is activated to send an excitation signal to a transponder on the emergency vehicle. The transponder responds with the emergency vehicle ID. The transceiver in the vehicle in the "car-active" system or the transceiver at the intersection in the "car-passive" system, transmit position information to the traffic controller to preempt operation of the traffic signals.

17 Claims, 6 Drawing Sheets

FIG. 1

U.S. PATENT DOCUMENTS

| | | | | | |
|---|---|---|---|---|---|
| 4,775,865 | A | | 10/1988 | Smith et al. | |
| 4,791,571 | A | | 12/1988 | Takahashi et al. | |
| 4,799,162 | A | | 1/1989 | Shinkawa et al. | |
| 4,914,434 | A | | 4/1990 | Morgan et al. | |
| 4,963,889 | A | | 10/1990 | Hatch | |
| 5,014,052 | A | * | 5/1991 | Obeck | 340/906 |
| 5,043,736 | A | | 8/1991 | Darnell et al. | |
| 5,068,656 | A | | 11/1991 | Sutherland | |
| 5,072,227 | A | | 12/1991 | Hatch | |
| 5,083,125 | A | * | 1/1992 | Brown et al. | 340/906 |
| 5,089,815 | A | * | 2/1992 | Potter et al. | 340/905 |
| 5,119,102 | A | | 6/1992 | Barnard | |
| 5,172,113 | A | * | 12/1992 | Hamer | 340/907 |
| 5,177,489 | A | | 1/1993 | Hatch | |
| 5,187,373 | A | | 2/1993 | Gregori | |
| 5,187,476 | A | | 2/1993 | Hamer | |
| 5,204,675 | A | * | 4/1993 | Sekine | 340/933 |
| 5,214,757 | A | | 5/1993 | Mauney et al. | |
| 5,334,974 | A | | 8/1994 | Simms et al. | |
| 5,345,232 | A | | 9/1994 | Robertson | |
| 5,539,398 | A | | 7/1996 | Hall et al. | |
| 5,602,739 | A | | 2/1997 | Haagenstad et al. | |
| 5,710,555 | A | | 1/1998 | McConnell et al. | |
| 5,745,865 | A | | 4/1998 | Rostoker et al. | |
| 5,889,475 | A | | 3/1999 | Klosinski et al. | |
| 5,926,113 | A | | 7/1999 | Jones et al. | |
| 5,955,968 | A | | 9/1999 | Bentrott et al. | |
| 5,986,575 | A | | 11/1999 | Jones et al. | |
| 6,064,319 | A | * | 5/2000 | Matta | 340/917 |
| 6,232,889 | B1 | | 5/2001 | Apitz et al. | |
| 6,243,026 | B1 | * | 6/2001 | Jones et al. | 340/906 |
| 6,326,903 | B1 | | 12/2001 | Gross et al. | |
| 6,603,975 | B1 | | 8/2003 | Inouchi et al. | |
| 6,617,981 | B1 | * | 9/2003 | Basinger | 340/909 |
| 6,621,420 | B1 | | 9/2003 | Poursartip | |
| 6,633,238 | B1 | * | 10/2003 | Lemelson et al. | 340/909 |
| 6,690,293 | B1 | * | 2/2004 | Amita | 340/928 |
| 6,724,320 | B1 | * | 4/2004 | Basson et al. | 340/906 |
| 6,909,380 | B1 | | 6/2005 | Brooke | |
| 2005/0104745 | A1 | * | 5/2005 | Bachelder et al. | 340/906 |

FOREIGN PATENT DOCUMENTS

| | | | |
|---|---|---|---|
| FR | 2 670 002 | A1 | 6/1992 |
| FR | 2 693 820 | A1 | 1/1994 |

OTHER PUBLICATIONS

Co-pending U.S. Appl. No. 10/704,530; filed Nov. 7, 2003, entitled Method and System for Beacon/Heading Emergency Vehicle Intersection Preemption.

Co-pending U.S. Appl. No. 10/811,075; filed Mar. 24, 2004, entitiled Emergency Vehicle Traffic Signal Preemption System.

Co-pending U.S. Appl. No. 10/696,490; filed Oct. 28, 2003, entitled Method and Apparatus for Alerting Civilian Motorists to the Approach of Emergency Vehicles.

Co-pending U.S. Appl. No. 10/965,408; filed Oct. 12, 2004, entitled Traffic Preemptin System.

Co-pending U.S. Appl. No. 10/942,498; filed Sep. 15, 2004, entitled Forwarding System for Long-Range Preemption and Corridor Clearance for Emergency Response.

Co-pending U.S. Appl. No. 10/960,129; filed Oct. 6, 2004, entitled Detection and Enforcement of Failure-to-Yield in an Emergency Vehicle Preemption System.

Gunnar Andersson, article entitled *Fleet Management in Public Transport*, The 3rd International Conference on Vehicle Navigation & Information Systems, Oslo, Sep. 2-4, 1992, 3 pgs.

James R. Helmer, *Intelligent Vehicle Highway Systems at Work in San Jose, California*, 3 pgs.

Horst E. Gerland, *ITS Intelligent Transportation System: Fleet Management with GPS Dead Reckoning, Advanced Displays, Smartcards, etc.*, IEEE-IEE Vehicle Navigation & Information Systems Conference, Ottawa - VNIS '93, 6 pgs.

Robert F. Casey, M.S., Lawrence N. Labell, M.S., *Evaluation Plan for AVL Implementation in Four U.S. Cities,* May 17-20, 1992 IVHS America Proceedings, 11 pgs.

N.B. Hounsell and M. McDonald, Contractor Report 88, Transport and Road Research Laboratory, Department of Transport, *Bus priority by selective detection,* 3 pgs.

David A. Blackledge et al., *Electronic Passenger Information Systems - Do They Give the Public What They Want?* , PTRC 19th Summer, Sep. 9-13, 1991 Annual Meeting, 14 pgs.

American City & County Website, http:/www.americancityandcounty.com, *City uses technology to track buses, emergency vehicles,* Jun. 1, 2001, 1 pg.

A. Kirson et al., *The Evolution of ADVANCE,* Development and Operational Test of a Probe-Based Driver Information System in an Arterial Street Network: a Progress Report, The 3rd International Conference on Vehicle Navigation & Information Systems, 1pgs.

Volume Two, The Proceedings of the 1992 Annual Meeting of IVHS America, Surface Transportation and the Information Age, May 17-20, 1992, Newport Beach, CA, 13 pgs.

Labell et al., *Advanced Public Transportation Systems: The State of the Art, Update '92,* U.S. Department of Transportation Federal Transit Administration, 97 pgs.

Stearns et al., *Denver RTD's Computer Aided Dispatch/Automatic Vehicle Location System: the Human Factors Consequences,* Sep. 1999, 82 pgs.

APTS Project Summaries, http:/www.itsdocs.fhwa.dot.gov, *Advanced Public Transportation Systems (APTS) Project Summaries,* Jun. 1996, Officeof Mobility Innovation, 33 pgs.

Canadian Urban Transit Association, *Proceedings, The International Conference on Automatic Vehicle Location in Urban Transit Systems,* Sep. 19-21, 1988, Ottawa, Canada, 17 pgs.

1991 TAC Annual Conference, *Proceedings,* vol. 4, Transportation: Toward a Better Environment, 21 pgs.

Caset et al., *Advanced Public Transportation Systems: The State of the Art,* U.S. Department of Transportation Urban Mass Transportation Administration, Component of Departmental IVHS Initiative, Apr. 1991, 91 pgs.

Brendon Hemily, Phd., *Automatic Vehicle Location in Canadian Urban Transit; a Review of Practice and Key Issues,* Dec. 1988, AATT Conference Feb. 1989, 17 pgs.

U.S. Department of Transportation, *German "Smart-Bus" Systems, Potential for Application in Portland, Oregon, vol. 1, Technical Report,* Jan. 1993, Office of Technical Assistance and Safety, Advanced Public Transportation Systems Program, A Component of the Departmental IVHS Initiative, 107 pgs.

Arup, *Traffic Management for Bus Operations Main Report,* Prepared by Ove Arup Transportation Planning for the Public Transport Corporation, Dec. 1989, 123 pgs (front and back).

Randy D. Hoffman, et al. *DGPS, IVHS Drive GPS Toward Its Future,* GPS World Showcase, Dec. 1992, 1 pg.

Ivan A. Getting, *Getting—The Global Positioning System,* IEEE Spectrum, Dec. 1993, 7 pgs.

IVHS Study—Strategic Plan, Centennial Engineering, Inc., p.31.

Horst E. Gerland, FOCCS—*Flexible Operation Command and Control System for Public Transport,* PTRC 19th Summer Sep. 9-13, 1991 Annual Meeting, pp.139-150.

*Intelligent Investment,* World Highways/Routes Du Monde, Jan./Feb. 1997, p. 52.

*Traffic Preemption System for Emergency Vehicles Based on Differential GPS and Two-Way Radio,* Priority One GPS, Midwest Traffic Products, Inc., 4 pages.

*Traffic Signal Preemption for Emergency and Transit Vehicles Based on Differential GPS & Two-Way Radio,* Priority One GPS, Traffic Preemption System, 3 pgs.

*GPS and Radio Based Traffic Signal Preemption System for Emergency Vehicles,* Priority One GPS Specification for Emergency Vehicles, 7 pgs.

Emergency Preemption Systems, Inc. website, 2 pgs.

Sonic Systems website, *Traffic Preemption and Priority Systems,* 2 pgs.

*Strobecom I Optical Preemption Detector,* 1pg.

*Strobecom I Preemption Detector Assemblies,* 2 pgs.
*Strobecom I Interface Card and Card Cage,* 2 pgs.
*The Priority One GPS Concept for Emergency Vehicles,* http://www.mtp-gps.com/concept.html, Priority One GPS, 1 pg.
*Priority One GPS Traffic Preemption Hardware,* http://www.mtp-gps.com/hardware.html, Priority One GPS, 2 pgs.
*The Traffic Preemption System for Emergency Vehicles Based on Differential GPS and Two-Way Radio,* http://www.greenf.com/traffic.htm, Greenfield Associates website, 1999, 6 pgs.
Zhaosheng Yang and DeYong Guan, *Study on the Scheme of Traffic Signal Timing for Priority Vehicles Based on Navigation System,* 2001 IEEE, pp. 249-254.
Veerender Kaul, *Microwave Technology: Will it Threaten the Dominance of Optical Signal Preemption Systems?,* May 8, 2002, 5 pgs.
Horst E. Gerland, *Traffic Signal Priority Tool to Increase Service Quality and Efficiency,* Prepared for: APTA Bus Operations Conference 2000, Salem Apr. 2000, 9 pgs.
M. Miyawaki, et al., *Fast Emergency Preemption Systems (FAST),* 1999 IEEE, pp. 993-997.
K. Fox et al., *UTMCO1 Selected Vehicle Priority in th UTMC Environment (UTMCO1),* UTMCO1 Project Report 1 - Part A, Oct. 19, 1998, 45 pgs.
U.S. Department of Transportation, *Advanced Transportation Management Technologies,* Chapter 6, Transit-Management Systems, Publication No. FHWA-SA-97-058, Apr. 1997, pp. 6-1 through 6-23.
J.D. Nelson, et al., *The Modelling of Realistic Automatic Vehicle Locationing Systems for Service and Traffic Control,* Nov. 9, 1995-Nov. 11, 1995, pp.1582-1587.
*Assessment of the Application of Automatic Vehicle Identification Technology to Traffic Management,* Appendix C: Evaluation of Potential Applications of Automatic Vehicle Monitoring to Traffic Management, Federal Highway Administration, Jul. 1977, 28 pgs.
Robert N. Taube, *Bus Actuated Signal Preemption Systems: A Planning Methodology,* Department of Systems-Design, University of Wisconsin-Milwaukee, May 1976, 120 pgs.
*Assessment of the Application of Automatic Vehicle Identification Technology to Traffic Management,* Federal Highway Administration, Jul. 1977, 44 pgs.
R.M. Griffin and D. Johnson, *A report on the first part of the Northampton Fire Priority Demonstration Scheme-the 'before' study and EVADE,* Crown Copyright 1980, 4 pgs.
P.M. Cleal, *Priority for Emergency Vehicles at Traffic Signals,* Civil Engineering Working Paper, Monash University, Dec. 1982, 38 pgs.
P. Davies, et al., *Automatic Vehicle Identification for Transportation Monitoring and Control,* 1986, pp. 207-224.
N.B. Hounsell, *Active Bus Priority at Traffic Signals,* UK Developments in Road Traffic Signaling, IEEE Colloquium, May 5, 1988, 5 pgs.
C.B. Harris, et al., *Digital Map Dependent Functions of Automatic Vehicle Location Systems,* 1988 IEEE, pp. 79-87.
P.L. Belcher And I. Catling, *Autoguide-Electronic Route Guidance for London and the U.K.,* 1989 IEEE Road Traffic Monitoring, pp. 182-190.
N. Ayland and P. Davies, *Automated Vehicle Identification for Heavy Vehicle Monitoring,* 1989 IEEE Road Traffic Monitoring, pp. 152-155.
K. Keen, *Traffic Control at a Strategic Level,* 1989 IEEE Road Traffic Monitoring, pp. 156-160.
K. W. Huddart, *Chapter 7: Urban Traffic Control,* Mobile Information Systems, 1990 Artech House, Inc., 23 pgs.
S. Yagar and E. R. Case, *A Role for VNIS in Real-Time Control of Signalized Networks?,* 1991, pp. 1105-1109.
R. F. Casey, et al., *Advanced Public Transportation Systems: The State of the Art,* U.S. Department of Transportation, Apr. 1991, 91 pgs.
M. F. McGurrin, et al., *Alternative Architectures for ATIS and ATMS,* IVHS Proceedings, May 1992, pp. 456-467.
A. Ceder and A. Shmilovits, *A Traffic Signalization Control System with Enhancement Information and Control Capabilities,* 1992 Road Transport Informatics Intelligent Vehicle Highway Systems, pp. 325-333.
*Summary of Findings: Orange County IVHS Review,* Orange County Intelligent Vehicle/Highway Systems Study, JHK & Associates, Aug. 11, 1992, 86 pgs.
*Automatic Vehicle Location/Control and Traffic Signal Preemption Lessons from Europe,* Chicago Transit Authority, Sep. 1992, 140 pgs.
J.D. Nelson et al., *Approaches to the Provision of Priority for Public Transport at Traffic Signals: A European Perspective,* Traffic Engineering Control, Sep. 1993, pp. 426-428.
M. D. Cheslow and S. G. Hatcher, *Estimation of Communication Load Requirements for Five ATIS/ATMS Architectures,* 1993 Proceedings of the IVHS America, pp. 473-479.
M. Kihl and D. Shinn, *Improving Interbus Transfer with Automatic Vehicle Location Year One Report,* Aug. 1993, 35 pgs.
L. Sabounghi et al., *The Universal Close-Range Road/Vehicle Communication System Concept The Numerous Applications of the Enhanced AVI,* 1991 TAC Annual Conference, pp. A41, A43-A62.
R. L. Sabounghi, *Intelligent Vehicle Highway System - The Universal Close-Range Road/Vehicle Communication System Concept - The Enhanced AVI and Its CVO Applications,* 1991, VNIS '91, Vehicle Indication and Information Systems Conference Proceedings, pp. 957-967.
Clarioni, et al., *Public Transport Fleet Location System Based on DGPS Integrated with Dead Reckoning,* Road Vehicle Automation, Jul. 12, 1993, pp. 259-268.

* cited by examiner

EMERGENCY VEHICLE CONTROL SYSTEM TRAFFIC LOOP PREEMPTION

Priority of U.S. Provisional Application Ser. No. 60/371,037 filed Apr. 9, 2002 is hereby claimed.

BACKGROUND OF THE INVENTION

1. Field of the Invention

This invention relates to emergency vehicle control systems for providing warnings of approaching emergency vehicles at intersections and more particularly relates to an emergency vehicle control system that utilizes traffic loop for preemption of traffic signals at an intersection.

2. Background Information

Using existing technology current traffic loops are normally used to detect the presence of cars at an intersection. These traffic loop detectors activate and control the operation of traffic lights at intersections according to the approach of vehicles.

In the past decade, several approaches have been taken to provide traffic signal preemption for emergency vehicles. Existing systems use strobe lights to activate optical receivers at an intersection. Other systems use noise pattern recognition to preempt based on approaching sirens. Recent systems have been developed using Global Positioning Systems (GPS); this has shown to be very effective in light metropolitan and rural areas. However each of these systems have drawbacks.

The strobe phase preemption system has the drawback that an optical line of sight is required. Further the viewing angle of the optical receiver (problems with hills and turns) and range preemption is limited to a few hundred feet. Also the receiver units and installation in vehicles are expensive.

Noise pattern detection systems use siren noise detection and recognition for preemption. This is not advantageous because the direction of the sound is required. Also ambient noises can diminish the detection of siren noise such as traffic, horns, general traffic noises at intersections. Another drawback is that the siren noise recognition is of course severely limited by distances.

GPS based preemption systems while effective also have some drawbacks. Such systems because they are very technical inherently require very expensive equipment. The system can also have difficulties because of vehicle position (buildings, bridges, large cities, etc.) can occlude the signal. Further the system is entirely dependent upon GPS satellites and selected positioning modes.

Investigations have determined that GPS (when available) is very effective at the timing and determination of vehicle position. Original versions of software (and hardware) designed for highly accurate map-matching have precise location determination of the emergency vehicle. The timing of the pedestrian and clearing phases at an intersection was incorporated into calculations of when to start preemption at any given intersection. There was concern that GPS-based system would not be accurate enough based on the limited selected positional accuracy. However even when the selected position was still activated (at an accuracy of no more than ±50 meters), it was found the system could adapt effectively. Therefore the approach to the preemption algorithm became more of a statistical calculation rather than a precise estimated-time-to-arrival calculation. In other words, given occasional accurate positioning the system could effectively compensate for large deviation between accurate position locks.

One of the reasons the system could accept such large deviations in the system of the car was due to the appearance of normal behavior at any given intersection. When pedestrians and motorists are not aware that an intersection was preempted, they simply didn't care. As long as a traffic light was returned to normal operation within approximately two minutes, this was seemingly no awareness of any problem. Given the infrequency of an emergency vehicle passing through a given intersection throughout the day, the frequency that related delays would exceed two minutes is negligible. This allows loose margins on when to start preempting. In other words even if a system determines there is only a 50 percent probability that a vehicle is going through an intersection, it could still preempt without noticeable disruption in traffic.

It is important to note that an emergency vehicle warning system such as that disclosed and described in U.S. Pat. Nos. 4,704,610 and 4,775,865 has two components: (1) the preemption of a traffic light and (2) a visible LED sign that alerts motorists to oncoming emergency vehicles. If the LED sign is used in conjunction with the invention disclosed herein, the motorist is aware of an act of preemption. Thus, the two-minute limitation does not apply. The LED sign requires much more active positioning to avoid "false warnings" (and likewise) "late-warnings".

In designing a preemptive system it was apparent that the system of the patents disclosed hereinabove would not function effectively in congested areas such as: large metropolitan cities, tunnels, and under bridges. When the lessons learned about accuracy are applied to the GPS limitations, it is clear that a truly effective preemption system only requires accurate vehicle positioning at critical nodes in the system (nodes being key signal equipped intersections). Between intersections, even using rough calculations based on dead reckoning, a system can produce highly effective predictions on when to preempt oncoming lights without causing unnecessary disruption in traffic flow.

Accordingly it is one object of the present invention to provide a traffic light preemption system for use in emergency vehicle warning system utilizing current traffic loops normally used to detect the presence of cars at an intersection.

Another object of the present invention is to provide a traffic signal preemption system utilizing existing traffic loops having a "car-active" system that relies on an on-board car computer to relay real-time vehicle positioning and travel information to surrounding intersections.

Still another object of the present invention is to provide a traffic light preemption system utilizing existing traffic loops that is "car-passive" and relies on road-based detection and communications to identify vehicles as they pass.

BRIEF DESCRIPTION OF THE INVENTION

The purpose of the present invention is to provide a traffic light preemption system for use with existing emergency vehicle warning systems. The traffic light preemption system is efficient and economical because it is based on current traffic loops under the road paving that are used to detect the presence of cars at an intersection which can be relied on to provide vehicle positioning information. The system disclosed herein may be used with the systems disclosed in U.S. Pat. Nos. 4,704,610 and 4,775,865 incorporated herein by reference.

Two types of systems have been designed to utilize existing traffic loops for vehicle positioning. One of these systems is a "car-active" traffic loop preemption system that uses a pass-through (transparent to normal behavior of the traffic loop) element between the traffic loop and the traffic loop control box. Another system disclosed herein is a "car-passive" traffic loop preemption system that uses a passive RF transponder (no battery) about the size of a credit card that may be affixed to the underside of the vehicle. The "car-active" traffic loop preemption system detects a car when it travels over existing or current traffic loops. The traffic loop activates the pass-through element, resulting in RF transmission of a tag including position (in the form of latitude/longitude) and direction. Any "subscribing" vehicle within close proximity to the traffic loop receives the transmission.

The key innovative and unique technology disclosed herein is the application of current traffic loop positioning to emergency vehicle preemption of traffic lights. If a "subscribing" vehicle is an active emergency vehicle, a receiver in the vehicle detects the tag and the car is given an accurate position at that precise moment. This position is forwarded to the neighboring intersections via transceiver on a real-time basis (1 Hz is the baseline frequency).

As the active emergency vehicle travels between intersections, a crude and inexpensive dead-reckoning system (simple compass and integrated speed) adequately updates the position of the vehicle. Since the system is aware of the road system (using an on-board map-matching approach), it is discrete positioning problem (there are a limited subset of solutions to the problem). In layman's terms a car can only be on a street. As long as the error associated with the car's position is within ½ a street block, the system will function effectively for preemption purposes. Even if a vehicle's position on the correct street is off by 200+ feet in either direction, motorist's "lack of awareness" allow loose margins and early-bias preemption. The key is to err on the side of adequate time for preemption.

Importantly, the use of hysteresis is critical to effective preemption behavior. Suppose the system determines that the car is statistically likely to come through a given intersection. Once preempted, the intersection must remain preempted for an extended period of time regardless of whether the intersection receives additional "positive" preemptive signals from the same vehicle. In other words, once the statistical base for the decision to preempt exist, the system must sustain the preemptive status until either:

A. The intersection receives a higher statistical weight of the same car coming (positive) transmission and position) and extends the preemption.

B. The reasonable, non-intrusive preemptive time expires when one minute is the baseline.

The "car-passive" traffic loop preemption system uses a passive RF transponder (no battery) about the size of a credit card which is fixed to the underside of the vehicle. The transponder is energized by a continuous wave 450-Mhz RF signal generated by a power oscillator (also called an exciter). This power oscillator is linked to the existing inductive traffic loops which would act like a leaky transmission line. When excited by the signal from the power oscillator, the transponder replies with its vehicle identification number (VIN) broadcast at a second frequency of 900 Mhz.

The overall traffic surveillance scheme disclosed has five major design parameters that may be traded against each other, namely, transceiver power, transceiver/transponder frequencies, transponder system efficiency, transponder sensitivity, and transponder response time.

Transceiver power can be set near OSHA's maximum allowable level in order to achieve higher reliability. In order to distinguish transponder response from the transceiver excitation, two separate frequencies are used. These frequencies which are somewhat constrained by the FCC's allocation of the band usage is chosen with the goal of miniaturization of the transponder—the higher the frequency, the smaller the conformal antenna and transponder. Additionally the transceiver/transmission frequency must be set high enough to insure several redundant responses when the detected vehicle is over the traffic loop antenna. Transponder system efficiency is determined by the interaction of the conformal antenna, the harmonic generator, and the embedded digital circuit. Transponder system efficiency is also moderated by the effectiveness of the coupling between the existing traffic loop antenna in the road (which has been designed for a different application) and the transponder antenna.

The preferred "car-passive" system provides singular activation points (intersection nodes) to surrounding intersections. Unlike the "car-active" system, there is no tracking or predictive analysis performed between these nodes. The intersection themselves must be programed to preempt simply based on proximity. For conservative cities (bias towards normal, uninterrupted traffic) the algorithm at each intersection may only preempt if an adjoining (one light away) intersection detects an active emergency vehicle coming in its direction. For a more liberal bias, the algorithm is constructed specific to the intersection itself. In other words, a main boulevard may trigger several lights ahead of any activation due to the high likelihood the emergency vehicle would stay on high-speed route.

The "car-active" system provides a relatively high level of accuracy in comparison to the "car-passive" system as vehicle updates (based on tracking hardware) are provided every second. This translates into more efficient and flexible preemption of traffic lights. However since the "car-active" system relies on vehicle transponders (on-board computer, transceiver, and battery connection), it requires significant cost added to the vehicle. Conversely, the "car-passive" system only requires a simple passive element without any power which is much more economical.

It should be also noted that either system ("car-active" or "car-passive") can function in conjunction with a GPS-based system. If GPS is occluded (i.e., between buildings) or not functional, the system can "fall back" to the traffic loop, dead-reckoning system disclosed herein. The two systems are complementary, especially when a city only wants to augment the minimal number of traffic loops.

The above and other objects, advantages, and novel features of the invention will be more fully understood from the following detailed description and the accompanying drawings, in which:

DETAILED DESCRIPTION OF THE INVENTION

Figure 1:
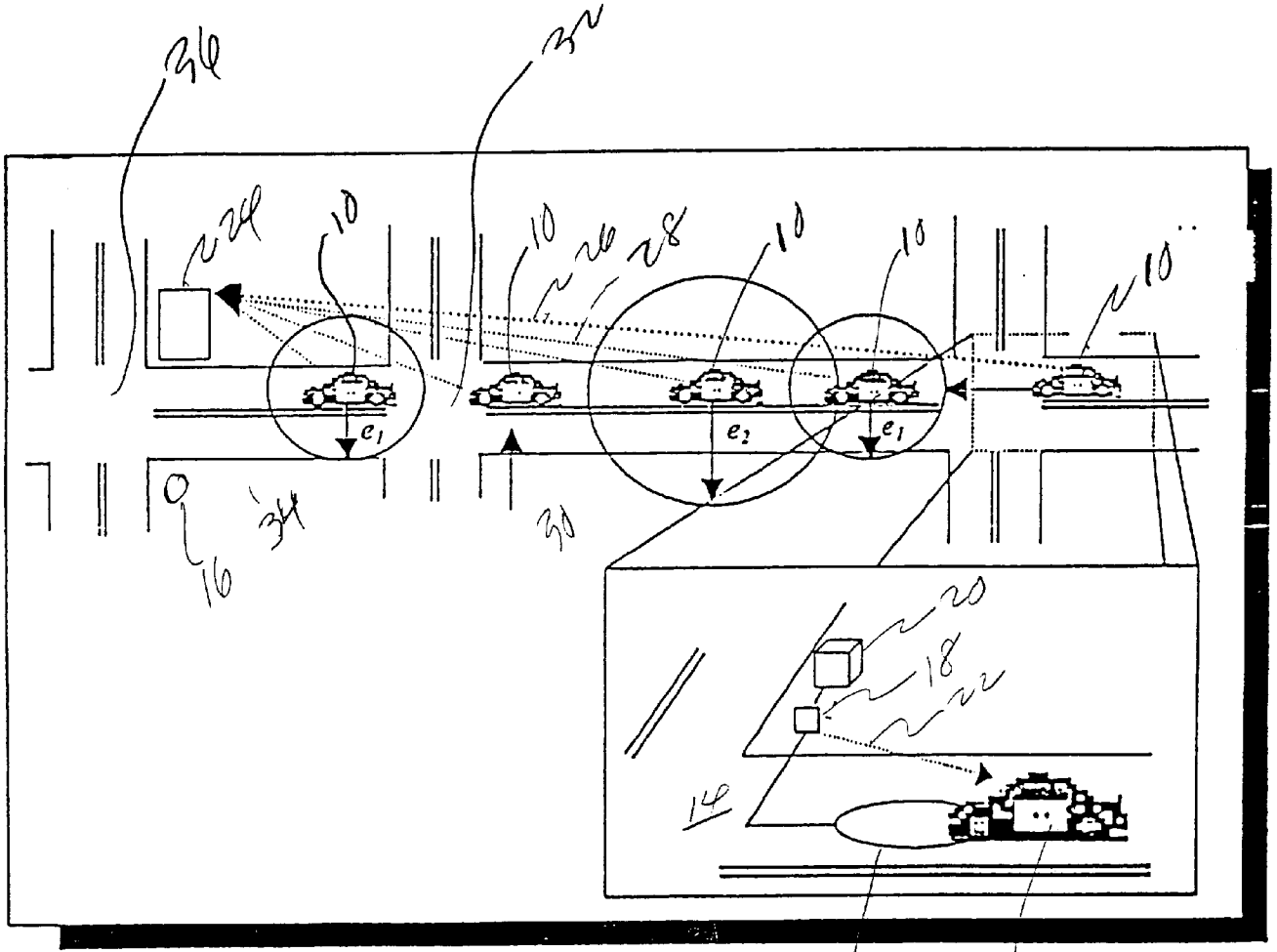
FIG. 1 is a diagram illustrating the "car-active" traffic loop preemption system according to the invention.
Figure 2:
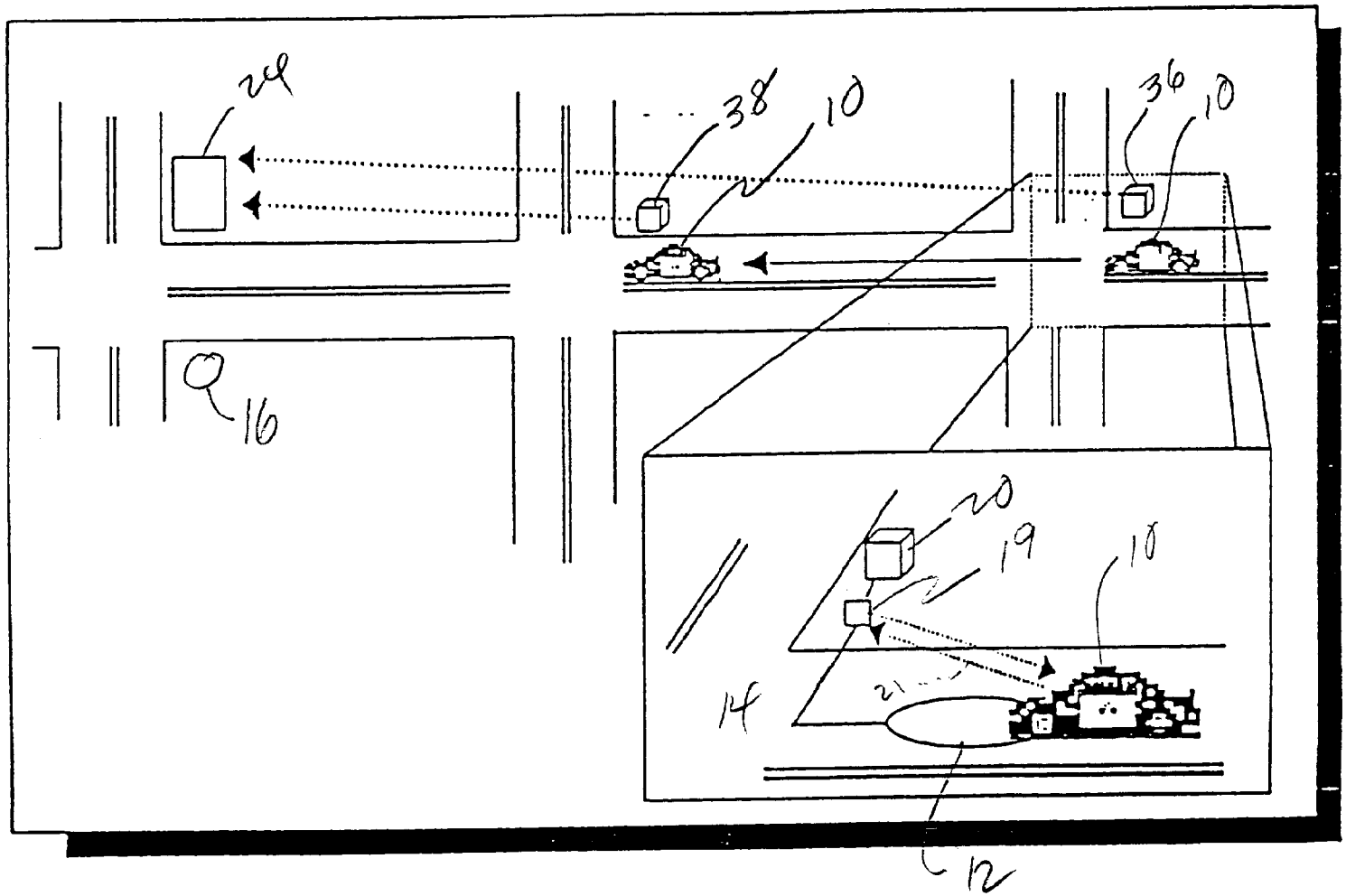
FIG. 2 is a diagram illustrating the "car-passive" traffic loop preemption system according to the invention.

A "car-active" traffic loop preemption using a pass-through (transmitter to normal behavior of the traffic loop) element between the traffic loop and the traffic loop control box according to the invention is illustrated in FIG. 1. This traffic loop preemption system is designed for use with the emergency vehicle warning and traffic control system such as that shown in U.S. Pat. Nos. 4,704,610 and 4,775,865 of Michael R. Smith et al issued Nov. 3, 1987 and Oct. 4, 1988, respectively and incorporated herein by reference. The traffic light preemption system disclosed herein can be used with systems disclosed there, GPS systems, or as an adjunct to any of the systems available.

As shown in FIG. 1, when a vehicle 10 travels over inductive traffic loop 12 embedded in pavement 14 of a roadway, vehicle 10 will be detected. Inductive loop 12 also activates a pass-through element resulting in RF transmission of a tag including position (in the form of latitude/longitude and direction). Any "subscribing" vehicle within close proximity of loop 12 receives the transmission.

An important, unique innovative aspect of the invention is the application of the inductive traffic loop 12 positioning to emergency vehicle 10 preemption of traffic signal(s) 16 at an intersection. If an active emergency vehicle 10, shown in a number of different positions in FIG. 1, is a "subscribing" vehicle, a transceiver (not shown) in the vehicle detects a tag and the vehicle is given an accurate position at that precise moment. This position is forwarded (i.e., transmitted) as indicated at 18 to neighboring intersections via the emergency vehicle transceiver on a real-time basis (1 Hz is a baseline frequency).

As the active emergency vehicle 10 travels between intersections, a basic and inexpensive dead-reckoning system (a simple compass and integrated speed) adequately updates the position of the vehicle. Since the system is aware of the road system (using an on-board map-matching approach), it is a discrete positioning problem (there are a limited subject of solutions to the problem). In layman's terms, vehicle 10 can only be on a street or roadway 14. As long as the error associated with the position of vehicle 10 is within a one half street block, the system will function effectively for preemption purposes. Even if the position of vehicle 10 on the correct street is offered by 200+ feet in either direction, motorists "lack of awareness" allow loose margin and early biased preemption. The key is to error on the side of adequate time for preemption of traffic light 16.

A "car-active" traffic loop preemption system is illustrated generally in FIG. 1. The inductive traffic loop preemption uses a pass-through element between inductive traffic loop 12 and traffic loop control box 20. When vehicle 10 travels over inductive traffic loop 12, the vehicle is detected and a fixed position is obtained. Likewise inductive loop 12 also activates pass-through passive element 18 that results in an RF transmission of a tag indicated at 22 including position (in the form of latitude/longitude and direction) to a transceiver (not shown) in vehicle 10. Any subscribing vehicle 10 within close proximity of inductive loop 12 receives a transmission.

Since vehicle 10 is a "subscribing" active emergency vehicle, transceiver in vehicle 10 detects the ID tag transmitted by passive element 18 and is given an accurate position $e_1$ at that precise moment. This fixed position is forwarded to traffic controller 24 and neighboring intersections via the emergency vehicle transceiver on a real-time basis (1 Hz is the baseline frequency). Predictive position updates ($e_2$ and $e_3$) from vehicle 10 are also transmitted to traffic controller 24 as indicated at 28 and 30. The intermediate predictive position is determined by a dead-reckoning system. At the next intersection 32 another fixed position $e_1$ is obtained by an inductive traffic loop (not shown) at that intersection with a subsequent predictive position update $e_2$ being transmitted. Traffic controller 24 therefore preempts the traffic light 16 at intersection 36 as emergency vehicle 10 approaches.

A "car-passive" traffic loop preemption using a passive RF transponder (no battery) about the size of a credit card is affixed to emergency vehicle 10. The transponder in vehicle 10 is energized by continuous 450 Mhz RF signal generated by power oscillator 19 (also called an exciter). Power oscillator 19 is connected to existing inductive traffic loop 12 which acts like a leaky transmission line. When excited by the signal from power oscillator 19 the transponder in vehicle 10 replies as indicated at 21 with its vehicle identification number (VIN) broadcast at a second frequency of 900 Mhz. The position of vehicle 10 is updated by transmissions from traffic loop boxes 36 and 38 only when a car passes an intersection. Thus a traffic controller 24 is constantly updated as vehicle 10 travels along roadway 14 but there are no intermediate updates.

The general configuration and layout at the intersection having traffic controller 24 for controlling the operation of traffic signal(s) 16 is illustrated in FIG. 1. The emergency vehicle warning system disclosed and described in the patents referred hereinabove includes an emergency warning sign 40 activated and controlled by traffic controller 24. Emergency warning sign 40 indicates the flow of emergency vehicles along roadways 42 and 44 while traffic controller 24 controls operation of the traffic signals at the intersection. Traffic loop circuit 46 transmits an exciter signal to vehicle 10 and receives a transmission signal with the emergency vehicle ID. Transmission to and from an emergency vehicle 10 are piggybacked on the inductive traffic loop. A vehicle detected by traffic loops 12 is detected by inbound traffic loop box 48 and transmitted over vehicle detect enable line 50 to traffic loop circuit 46.

Figure 3:
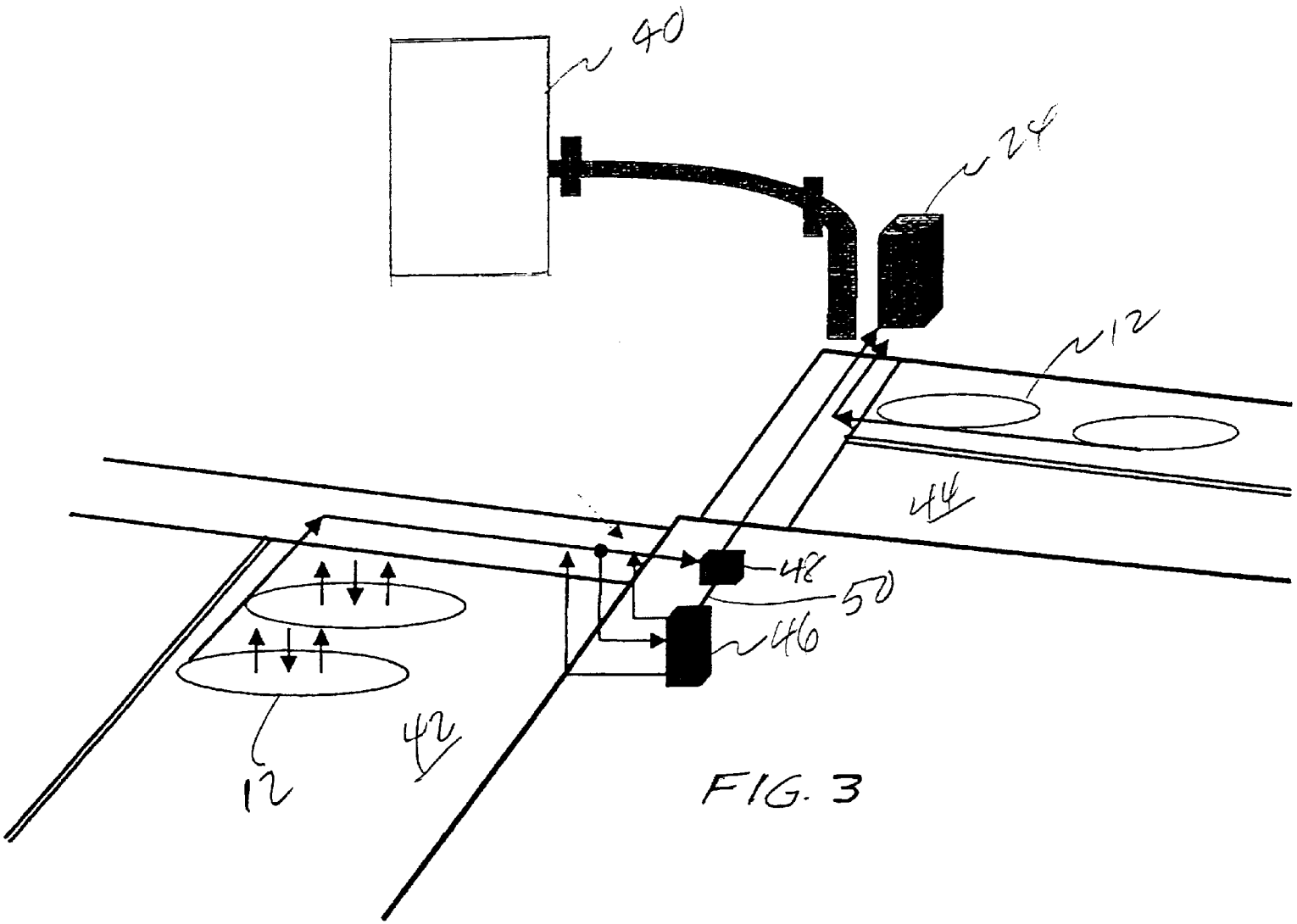
FIG. 3 is a diagram of an intersection illustrating the general configuration of a preemption system using existing traffic loops according to the invention.

The diagram in FIG. 3 shows the traffic loop layout configuration. The road embedded inductive traffic loop circuit 46 is a module that includes a signal condition, receiver and transmitter. All transmissions are received/sent via piggyback along inductive traffic loop hard-line assembly and the loop itself. The system illustrated is enabled anytime a vehicle is detected over inductive traffic loop 12 and all transmissions are low power to limit the distance of decoded transmission. In a "car-active" configuration, a longitude and latitude pair are provided to an emergency vehicle 10. In a "car-passive" configuration, vehicle 10 reflects (via exciter) its ID back to the active element of traffic loop circuit 46 at the intersection.

Figure 4:
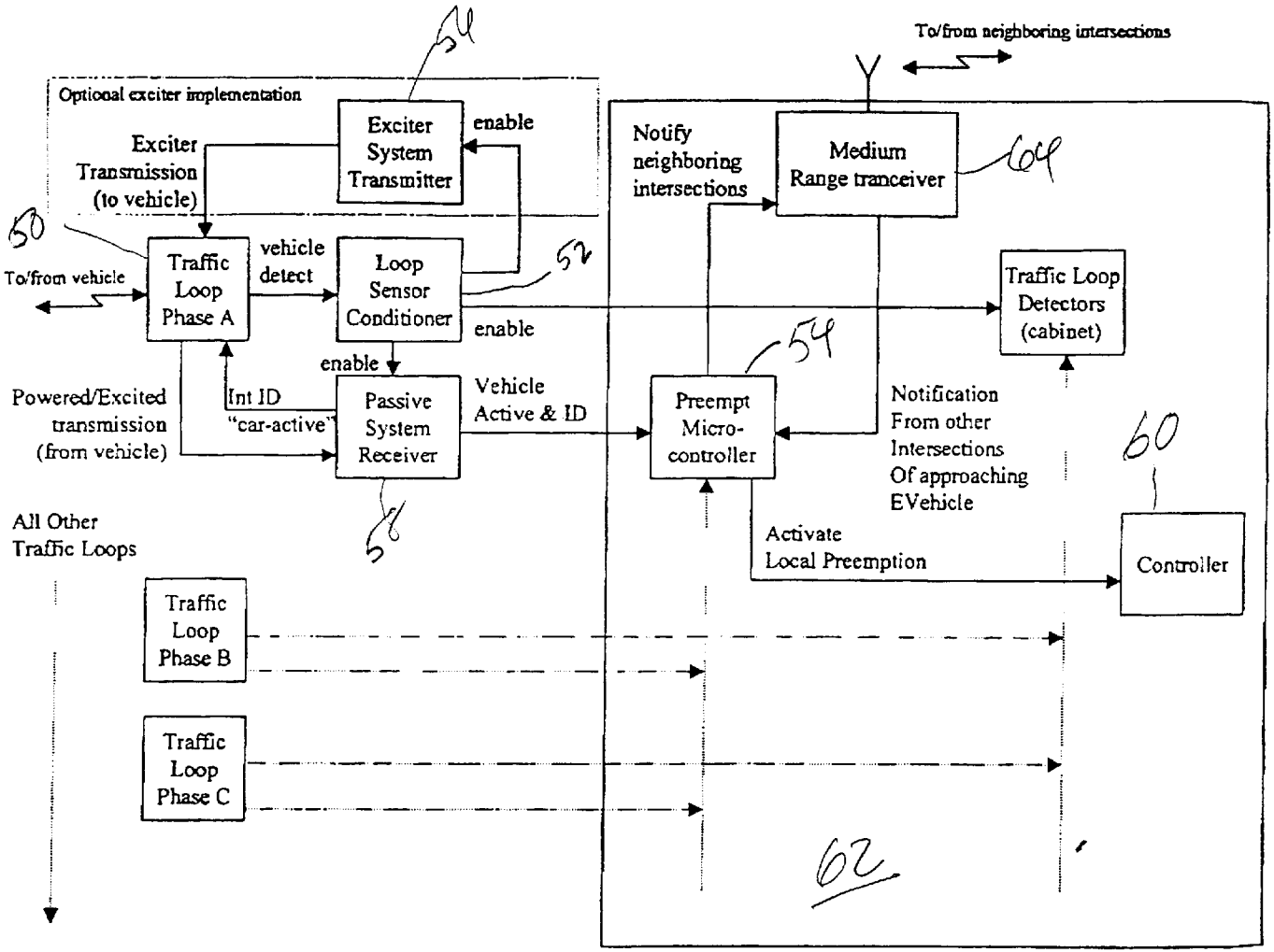
FIG. 4 is a schematic block diagram illustrating the general configuration of a traffic loop preemption system according to the invention.

The inductive traffic loop intersection hardware/data layout is illustrated in FIG. 4. This diagram illustrates the general hardware layout and data flow at each intersection. Each traffic loop 50 is attached to a primary conditioning box 52 along with an embedded preemption module 54. In a "car-passive" configuration, exciter system transmitter 56 sends an exciter signal to traffic loop 50 to energize passive system receiver 58 on the vehicle (and get an ID tag). In a "car-active" configuration, position information is transmitted via the loop. All preempt module 54 are connected to a central preempt controller 60 in the intersection traffic controller cabinet 62. Central preempt controller 60 is responsible for immediate preemption at the local intersection, forwarding position/ID information of triggering emergency vehicles to neighboring intersections and receiving/processing an external trigger from neighboring intersections. The notification to neighboring intersections and from neighboring intersections is through medium range transceiver 64.

Figure 5:
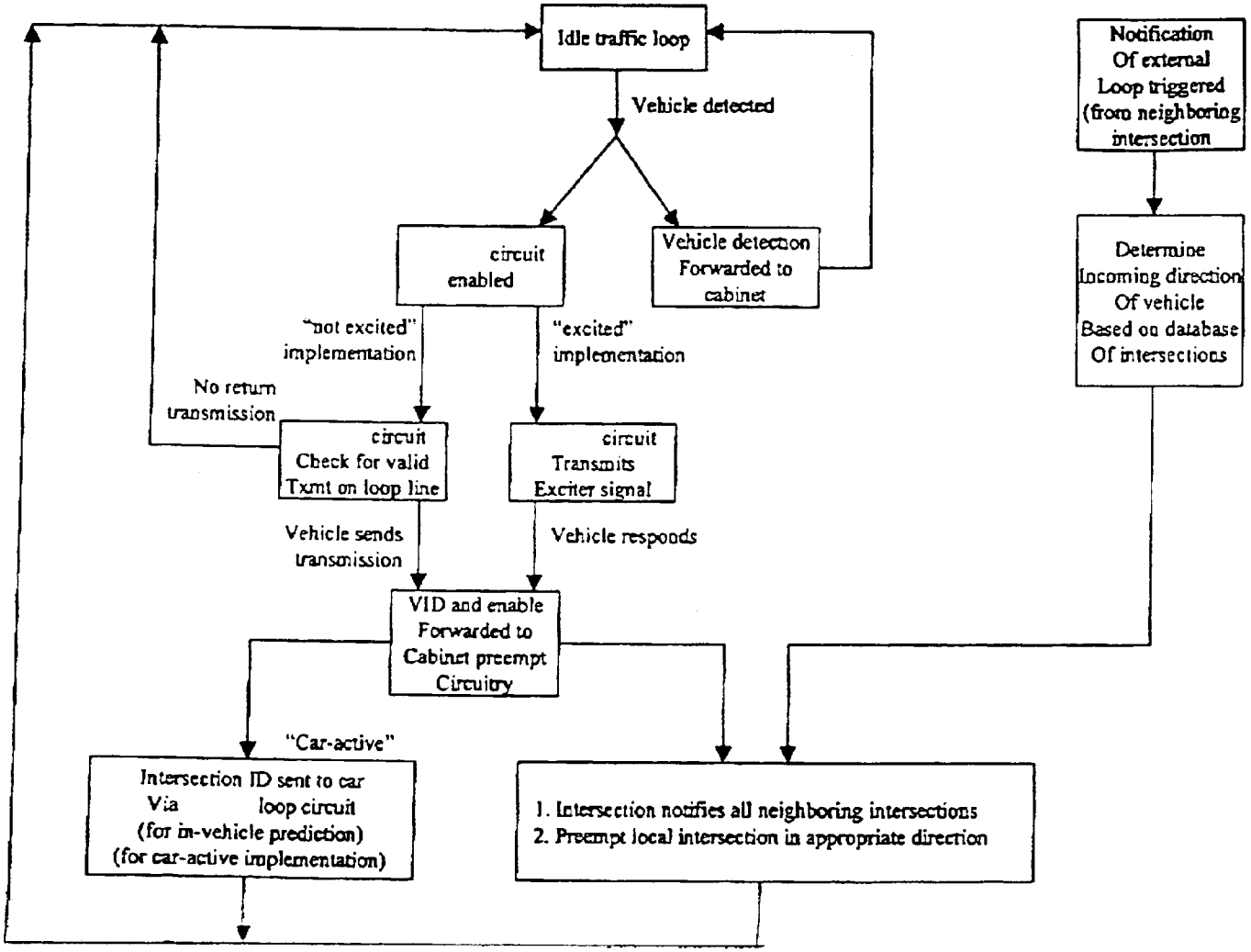
FIG. 5 is a flow diagram of a program for use with the traffic loop preemption system of FIGS. 1 and 2.

A traffic loop intersection system program flow diagram is illustrated in FIG. 5. This flow diagram outlines a combined functionality, logic-tree, and program of both embedded road units and cabinet preemption controller 60. The unique feature of the invention is the use of existing inductive traffic loops as both an activation device and localized antenna to obtain sufficiently accurate location information.

Figure 6C:
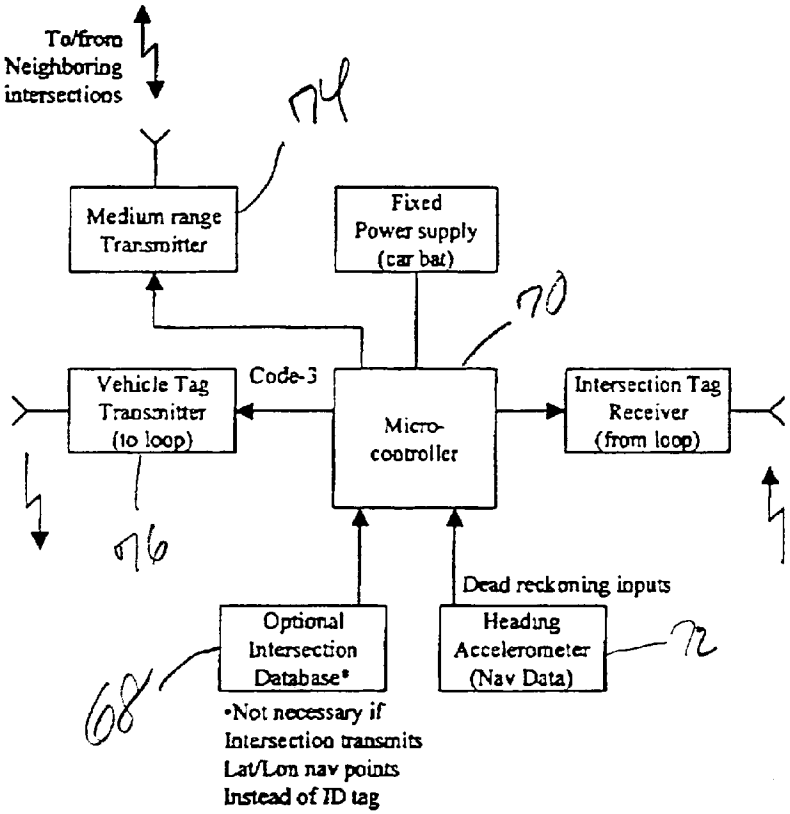
FIGS. 6*a* through 6*c* are schematic layout diagrams of in-vehicle hardware and data flow traffic loop preemption systems of FIGS. 1 and 2.
Figure 6B:
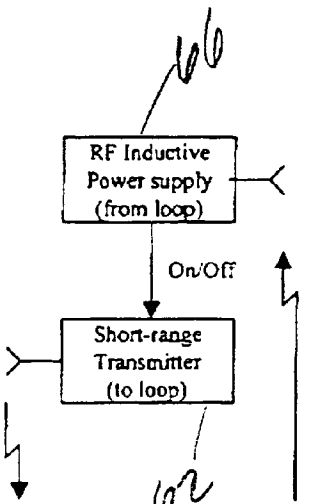
Figure 6A:
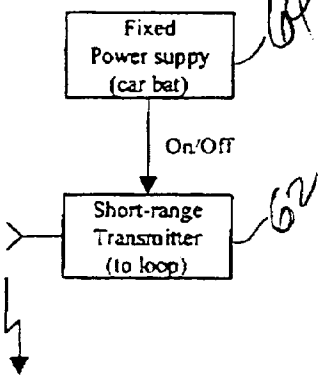
Figure 4:
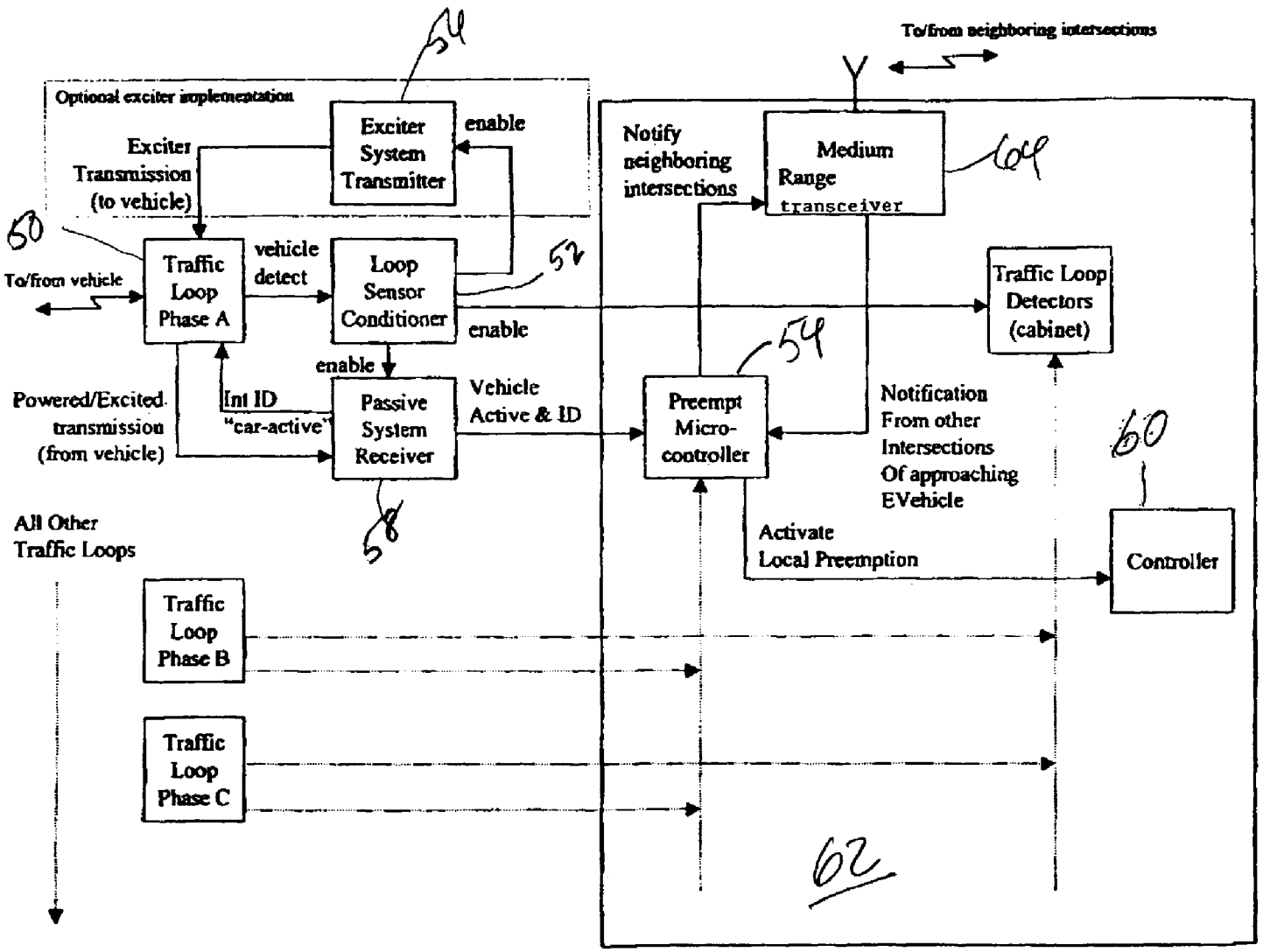

Traffic loop in-vehicle hardware/data layout is illustrated in FIGS. 6*a* and 6*c* which show possible vehicle configurations for the traffic loop preemption system disclosed herein. In the "car-passive" system, FIG. 6*a* illustrates the use of a short-range transmitter 62 powered by car battery 64. Short-range transmitter 62 transmit the vehicle ID to the traffic loop circuit. FIG. 6*b* illustrates a non-powered design where an RF inductive power supply 66 provides an output to short-range transmitter 62 which again transmits vehicle ID continuously or when pinged by the loop, respectively. This simple design makes a vehicle transponder extremely inexpensive and easy to install.

A third implementation of a vehicle system incorporates on-board-dead reckoning capability. When a vehicle passes a traffic loop, it receives either intersection ID to be looked up in database 68 or a latitude/longitude location. Each loop is used to "snap" a positive fixed location for dead-reckoning microcontroller receiving inputs from the optional intersectional database or latitude/longitude navigation inputs and heading accelerometer 72. Dead-reckoning microcontroller 70 continues to use additional onboard navigation data to estimate future positions. In the "car-active" system, vehicle 10 continues to broadcast its "best known" position to every neighboring intersection via medium range RF transmitter 74. As in the "car-passive" system, vehicle ID is still sent to each traffic loop vehicle tag transmitter 76 for recording and redundancy.

It is important to note that either system can function in conjunction with a GPS based system. If the GPS system is occluded or not functional, the system can "fall back" to the traffic-loop dead-reckoning system. The two systems are complementary, especially when a city only wants to augment the minimal number of traffic loops.

Thus there has been disclosed a novel traffic signal preemption system utilizing existing inductor traffic loops. The inductive traffic loops are already installed in most cities, with a diameter of about six feet providing a reliable detection of activity across a 10 ft. traffic lane. These six foot inductive traffic loops comprised of about 90 percent of the existing loop infrastructure. An advantage of using existing inductive loops is because they are insensitive to surface accumulation of water, ice, snow, mud, etc. The use of existing technology in the road and optionally using simple dead-reckoning equipment on emergency vehicles themselves, the system can insure the provision of accurate direction, distance, and robot preemption in highly congested areas. In the "car-active" system, accurate fixed position and intermediate predictor positions are continuously transmitted to a traffic controller. In the "car-passive" system, a transponder reacts to excitation from a continuous wave 450 Mhz RF signal generated by a power oscillator or exciter that responds with its VIN at a second frequency of 900 Mhz.

This invention is not to be limited by the embodiment shown in the drawings and described in the description which is given by way of example and not of limitation, but only in accordance with the scope of the appended claims.

What is claimed is:

1. A method for preempting traffic signals at an intersection comprising:

detecting an emergency vehicle at a first intersection via an embedded inductive traffic loop; and invoking a transmitter coupled to the traffic loop for transmitting position information to the emergency vehicle responsive to the detection of the emergency vehicle at the first intersection, the emergency vehicle forwarding the position information to a traffic controller at a second intersection;

wherein said traffic controller preempts traffic signals for controlling flow of traffic at the second intersection based on information on one or more positions transmitted by the emergency vehicle.

2. The method according to claim 1 including transmitting predictive intermediate position updates from said emergency vehicle to said traffic controller.

3. The method according to claim 2 comprising transmitting predictive intermediate position updates between intersections to said traffic controller.

4. The method according to claim 3 comprising transmitting predictive intermediate position updates between intersections that are determined by a dead-reckoning system.

5. The method of claim 1, wherein position of the emergency vehicle is determined based on the forwarded position information.

6. The method of claim 1, wherein the forwarded position information includes direction information.

7. A system for preempting traffic signals for controlling the passage of an emergency vehicle comprising:

a traffic controller for controlling the operation of traffic signals at a second intersection;

an inductive traffic loop at a first intersection detecting presence of an emergency vehicle at the first intersection;

a transmitter coupled to the traffic loop and transmitting position information to the emergency vehicle responsive to the detection of the emergency vehicle at the first intersection;

a transceiver in said emergency vehicle receiving the position information from said transmitter and forwarding said position information to said traffic controller at the second intersection;

wherein said traffic controller preempts traffic signals at the second intersection based on information on one or more positions transmitted by the emergency vehicle.

8. The system according to claim 7 wherein said transceiver transmits intermediate predictive position updates to said traffic controller.

9. The system according to claim 8 wherein said transceiver includes a dead-reckoning system, said intermediate predictive positions transmitted to said transceiver being determined by said dead-reckoning system.

10. The system according to claim 9, wherein said transceiver transmits a 4500 Mhz excitation signal to said transponder.

11. The system according to claim 10 in which said transponder transmits an emergency vehicle ID to the transceiver at a frequency of 900 Mhz.

12. The system of claim 7, wherein position of the emergency vehicle is determined based on the forwarded position information.

13. The system of claim 7, wherein the forwarded position information includes direction information.

14. A system for preempting traffic signals for controlling the passage of emergency vehicles comprising:

a traffic controller for controlling the operation of traffic signals at a second intersection;

an inductive traffic loop at a first intersection detecting presence of an emergency vehicle at the first intersection;

a transceiver coupled to the traffic loop, the transceiver being actuated to transmit a first signal in response to the detection of the emergency vehicle by said inductive loop;

a transponder on said emergency vehicle activated by the first signal transmitted by said transceiver and transmitting a second signal providing information about the emergency vehicle to said transceiver, said transceiver transmitting a third signal providing position information of the emergency vehicle to said traffic controller;

wherein said traffic controller preempts traffic signals at the second intersection based on the position information of the emergency vehicle.

15. The system of claim 14, wherein the position information includes direction information.

16. A method for preempting traffic signals at an intersection comprising:

detecting an emergency vehicle at a first intersection via an inductive traffic loop;

transmitting a first signal via a first transponder coupled to the traffic loop in response to the detection of the emergency vehicle;

activating a second transponder on the emergency vehicle based on the first signal and transmitting a second signal by the second transponder in response, the second signal providing information about the emergency vehicle; and transmitting a third signal by the first transponder in response to the second signal, the third signal providing position information of the emergency vehicle to a traffic controller at a second intersection, wherein the traffic controller preempts traffic signals at the second intersection based on the position information of the emergency vehicle.

17. The system of claim 16, wherein the position information includes direction information.

* * * * *

UNITED STATES PATENT AND TRADEMARK OFFICE

CERTIFICATE OF CORRECTION

PATENT NO. : 7,113,108 B1
APPLICATION NO. : 10/410582
DATED : September 26, 2006
INVENTOR(S) : Bachelder et al.

It is certified that error appears in the above-identified patent and that said Letters Patent is hereby corrected as shown below:

On the Title Page

| | |
|---|---|
| Item (56) References Cited<br>U.S. Patent Documents<br>pg. 2, Column 1<br>6,909,380 | Delete "B1",<br>Insert --B2-- |
| Item (56) References Cited<br>Other Publications, pg. 2, Column 1<br>Co-Pending U.S. Appl.<br>No. 10/965,408. . . | Delete "Preemptin",<br>Insert --Preemption-- |
| Item (56) References Cited<br>Other Publications, pg. 2, Column 2<br>A. Kirson et al., The Evolution of<br>ADVANCE. . . | Delete "1 pgs.",<br>Insert --1 pg.-- |
| Item (56) References Cited<br>Other Publications, pg. 2, Column 2<br>APTS Project Summaries, . . . | Delete "Officeof Mobility",<br>Insert --Office of Mobility-- |
| Item (56) References Cited<br>Other Publications, pg. 3, Column 1<br>K. Fox et al., UTMC01 Selected<br>Vehicle. . . | Delete "th UTMC",<br>Insert --the UTMC-- |
| Item (56) References Cited<br>Other Publications | Insert --Bernard Held, *Bus Priority: A Focus on the City of Melbourne*, August 1990, Monash University, pgs. 157-160, and 180-189 |

UNITED STATES PATENT AND TRADEMARK OFFICE

CERTIFICATE OF CORRECTION

PATENT NO. : 7,113,108 B1
APPLICATION NO. : 10/410582
DATED : September 26, 2006
INVENTOR(S) : Bachelder et al.

It is certified that error appears in the above-identified patent and that said Letters Patent is hereby corrected as shown below:

In the Drawings

| | |
|---|---|
| FIG. 4, Sheet 4 of 6, Ref. No. 64 | Delete Drawing Sheet 4 and substitute therefore the Drawing Sheet, consisting of Fig. 4, as shown on the attached page |
| Column 1, line 6 | Insert --STATEMENT REGARDING FEDERALLY SPONSORED RESEARCH OR DEVELOPMENT<br><br>The invention described herein was made in the performance of work under a NASA contract, and is subject to the provisions of Public Law 96-517 (35 U.S.C. 202) in which the contractor has elected to retain title.-- |

Signed and Sealed this

Eighth Day of September, 2009

David J. Kappos

David J. Kappos
*Director of the United States Patent and Trademark Office*